United States Patent [19]

Stokes

[11] 4,254,642

[45] Mar. 10, 1981

[54] VARIABLE SLOPE BOTTOM BASKET FOR AN ORBITAL CLOTHES WASHER

[75] Inventor: Vijay K. Stokes, Schenectady, N.Y.

[73] Assignee: General Electric Company, Schenectady, N.Y.

[21] Appl. No.: 109,052

[22] Filed: Jan. 2, 1980

[51] Int. Cl.³ ..... D06F 21/06

[52] U.S. Cl. ..... 68/172

[58] Field of Search ..... 68/147, 148, 152–154, 68/171–174, 232, 233, 23 R; 220/DIG. 28

[56] References Cited

U.S. PATENT DOCUMENTS

| | | | |
|---|---|---|---|
| 1,665,959 | 4/1928 | Graham et al. | 68/174 X |
| 3,087,776 | 4/1963 | Anderson | 68/174 X |

FOREIGN PATENT DOCUMENTS

| | | | |
|---|---|---|---|
| 1258187 | 2/1961 | France | 68/154 |

*Primary Examiner*—Philip R. Coe

*Attorney, Agent, or Firm*—Nathan D. Herkamp; James C. Davis, Jr.; Paul R. Webb, II

[57] ABSTRACT

A basket for an orbital washer is provided with a bottom wall having a variable slope. The angle of bottom slope varies from a maximum angle to a minimum angle in the circumferential direction about the axis of the basket. The slope variation causes changes in the rate of motion of clothes as the clothes move circumferentially within the basket, which change enhances turbulence of the clothes motion and, thereby, washing of the clothes.

9 Claims, 9 Drawing Figures

VARIABLE SLOPE BOTTOM BASKET FOR AN ORBITAL CLOTHES WASHER

BACKGROUND OF THE INVENTION

This invention relates to a basket for an orbital washer of the type described in U.S. Pat. application Ser. No. 39,406, filed May 15, 1979 by John Bochan, assigned to the instant assignee, and incorporated herein by reference thereto. Baskets designed for an orbital washer are described in my prior U.S. Pat. applications Ser. No. 98,226, filed 11/28/79 and Ser. No. 107,495, filed 12/26/79, each assigned to the instant assignee, and each incorporated herein by reference thereto.

An orbital washer as described in the above-cited U.S. Pat. application Ser. No. 39,406, employs a drive system, such as an eccentric gear drive system, which moves the basket in a particular generally horizontal orbital motion during its clothes washing and rinsing cycles. During the spin cycle, the basket is centered and rotated rapidly to remove excess water from the clothes.

As described in the above-cited U.S. Pat. application Ser. No. 98,226, motion of clothes inside a basket being driven in an orbital path, is caused by interaction of the clothes with the basket bottom and side wall. With a circular basket having a bottom sloping generally upwardly from the outer cylindrical wall toward the center post, clothes tend to move in a helical path continuously about the circumference of the basket. Energy transferred from the basket to the clothes by interaction of the clothes with the interior surfaces of the basket produces turbulent motion of the clothes, which washes the clothes. The shapes of the interior surfaces of the basket which contact the clothes determine the pattern of motion of the clothes within the basket during orbiting thereof. The above-cited U.S. Pat. application Ser. No. 98,226 describes an unsymmetrical basket design to achieve turbulence and mixing of the clothes by moving them in opposite senses within the basket. The above-cited U.S. Pat. application Ser. No. 107,495 describes a basket configuration which produces a tendency to generate opposed motion in separate portions of the basket to enhance mixing and turbulence of clothes within the basket during the orbital cycles of the machine.

SUMMARY OF THE INVENTION

An object of the instant invention is to provide a basket for an orbital washer having a basket bottom wall with a variable slope configuration, which causes a change in the rate of turn-around motion of clothes within the basket as they move from one portion of the basket to another along a helical path. Accordingly, the instant invention includes a basket configuration for an orbital washer having an outer generally cylindrical wall and an inner generally cylindrical post and a basket bottom wall which slopes continuously upwardly from said outer wall radially inwardly toward said post; and the slope of a first radially extending segment of said bottom wall varies from a large angle relative to a horizontal reference for said segment at one circumferential position of said basket bottom to a small angle relative to the same horizontal reference for a second radially extending segment of said bottom wall located circumferentially separated from said first segment about the circumference of said basket bottom wall.

BRIEF DESCRIPTION OF THE DRAWINGS

The features of the invention believed to be novel and unobvious over the prior art are set forth with particularity in the appended claims. The invention itself, however, as to organization, method of operation and advantages thereof, may best be understood by reference to the following description taken in conjunction with the accompanying drawings in which:

DESCRIPTION OF THE PREFERRED EMBODIMENTS

Figure 1:
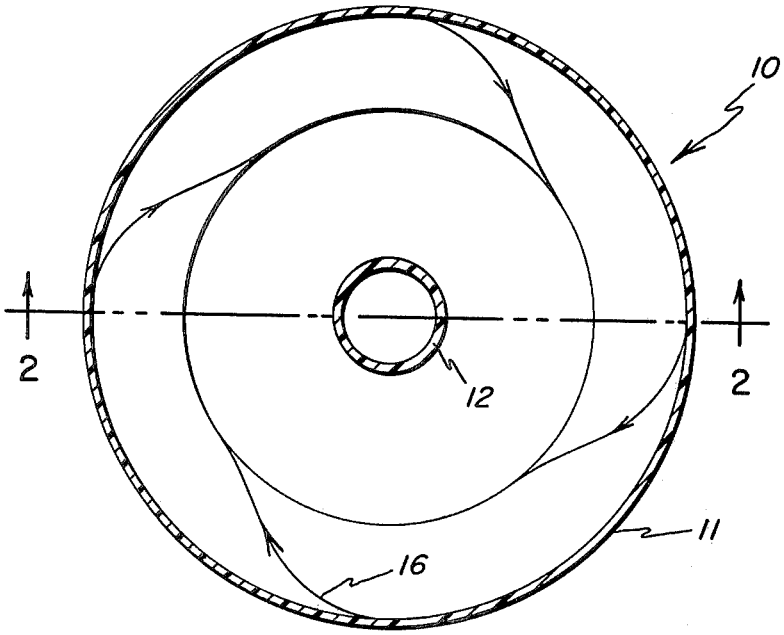
FIG. 1 is a schematic partial cross-sectional top view of a model of a basket for an orbital washer.

The specific features of the instant invention described herein and shown in FIGS. 1–9 are merely exemplary, and the scope of the invention is defined in the appended claims. Throughout the description and FIGS. 1–9, like reference characters refer to like elements of the invention.

Figure 2:
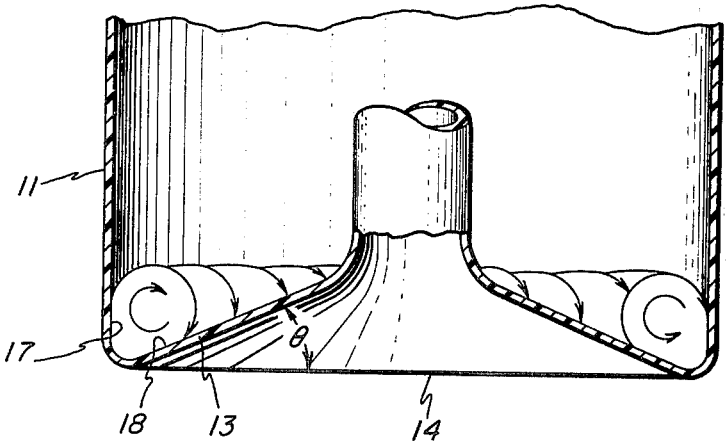
FIG. 2 is a schematic partial cross-sectional view of the model of FIG. 1 taken along line 2—2 thereof.

FIGS. 1 and 2 illustrate a model which demonstrates the action of a clothes load disposed in a basket 10, which comprises cylindrical outer wall 11, center post 12 and bottom wall 13 which slopes upwardly from outer wall 11 in the radial direction with an angle $\theta$ with respect to a horizontal reference line 14. If basket 10 is driven such that it moves with a counterclockwise orbit having an angular frequency $\omega$ and an amplitude a, clothes disposed within basket 10 will tend to move in a generally clockwise helical path as shown by arrows 16 due to interaction of the clothes with the interior surfaces 17, 18, respectively, of the outer wall 11 and bottom wall 13. If the direction of orbiting motion were reversed, i.e., the basket were orbited clockwise, the clothes load would tend to move in a counterclockwise helical path. The turn-around motion (i.e., motion in the circumferential direction) of the clothes on the inclined bottom surface 18 of basket 10 is facilitated, or enhanced, by a surface condition, which has a relatively low resistance to sliding movement of clothes in contact with surface 18 in the downward direction toward outer wall 11, but has a relatively high resistance to relative sliding movement of the clothes in contact with surface 18 in the upward direction toward center post 12. For fixed values of the amplitude a and the angular frequency $\omega$, the rate of turnaround motion increases with a decrease in the basket bottom slope $\theta$.

Employing the above analysis, a variable bottom slope basket 20, as shown schematically in FIGS. 3–6, is proposed for an orbital washer. The stretch-release action to which the clothes load is subjected upon impact with the surfaces of the basket and relative rubbing action between adjacent pieces of cloth during movement of the clothes produce washing of the clothes. Turbulent mixing of the clothes increases if the helix angle $\gamma$ of the clothes changes as the clothes move around the circumference of the basket. For a fixed RPM (i.e., fixed $\omega$) and a fixed orbit amplitude a, the magnitude of helix angle $\gamma$ would depend upon the magnitude of basket bottom slope $\theta$. Therefore, having a basket with a bottom whose slope $\theta$ varies in a periodic manner around the circumference of the basket would produce a periodic variation in the helix angle $\gamma$, and therefore enhance stretch-release and rubbing action within the clothes load disposed within the basket. This variation in helix angle $\gamma$ would also increase turbulence and the tendency of the clothes to mix, and thereby prevent the clothes from moving in a quasi steady-state motion (i.e., constant speed and direction), so that each portion of the clothes would be exposed to the basket inner surfaces and to rubbing contact with other pieces of the clothes load during some part of the washing cycle.

Figure 3:
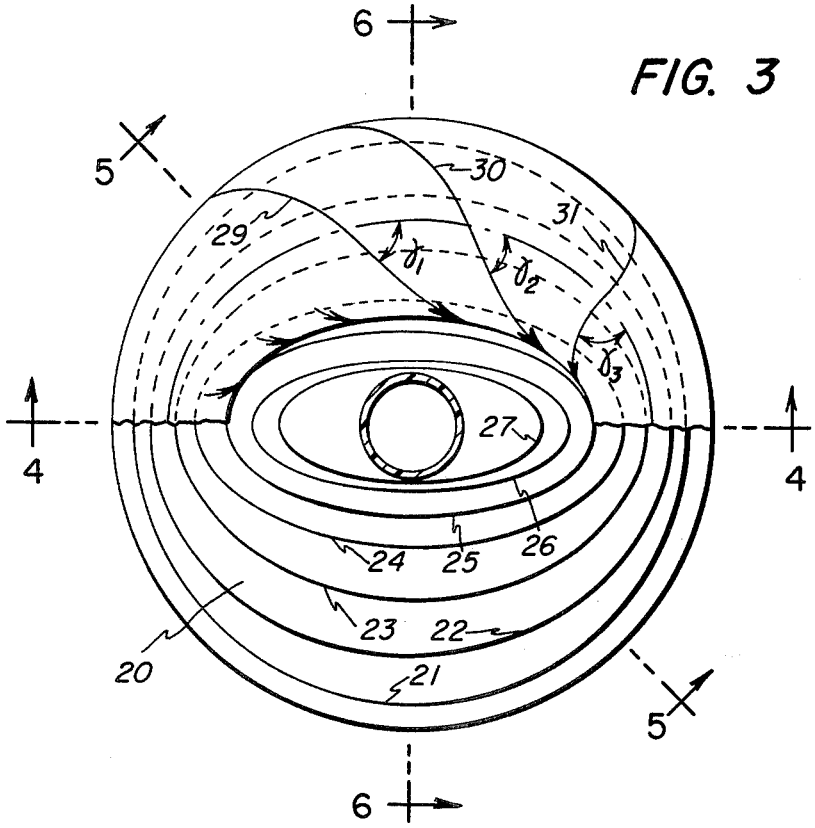
FIG. 3 is a schematic top plan view of a bottom wall for an orbital washer basket designed according to the instant invention.
Figure 4:
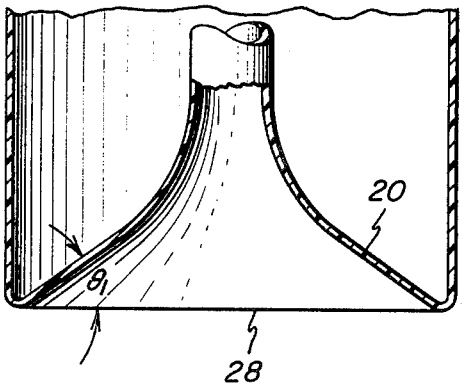
FIG. 4 is a schematic cross-sectional view of the basket bottom wall of FIG. 3 taken along line 4—4 thereof.
Figure 5:
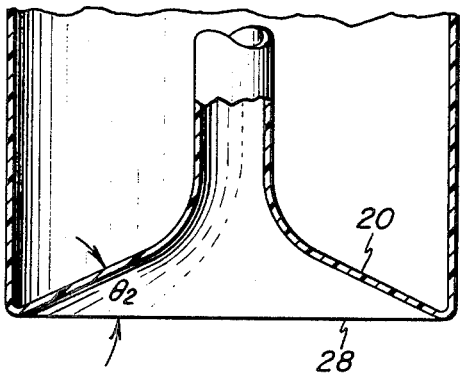
FIG. 5 is a schematic partial cross-sectional view of the basket bottom wall of FIG. 3 taken along line 5—5 thereof.
Figure 6:
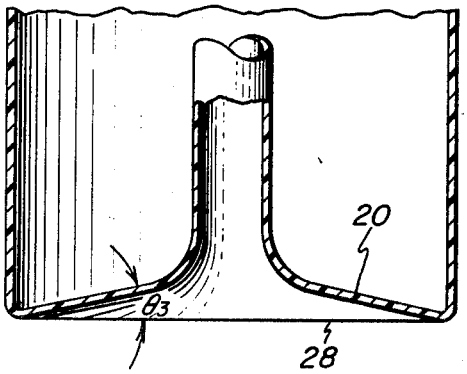
FIG. 6 is a schematic partial cross-sectional view of the basket bottom wall of FIG. 3 taken along line 6—6 thereof.

In FIGS. 3–6, a model basket bottom wall 20 is illustrated in which the slope angle $\theta$ varies continuously, i.e., each incremental circumferential segment of basket bottom wall 20 has a slope angle $\theta$ incrementally different from that of each circumferentially adjacent incremental circumferential bottom wall segment. This forms a smooth circumferential surface with a varying slope angle $\theta$, which varies continuously in the circumferential direction about the basket axis. The contour lines 21–27 represent lines of approximately uniform height of the basket bottom above reference line 28, so that it can readily be seen that the basket bottom passes through two cycles of change of $\theta$ around the circumference of basket bottom 20. In FIGS. 4–6, the relative magnitudes of angle $\theta$ at particular circumferential positions are illustrated. Angle $\theta_1$, FIG. 4, represents the slope angle of the incremental circumferential segment of basket bottom wall 20 relative to the horizontal reference line 28 at the cross section 4—4 of FIG. 3. Angle $\theta_2$, FIG. 5, represents the slope angle between basket bottom wall 20 and the horizontal reference line 28 at cross section 5—5 of FIG. 3. Angle $\theta_3$, FIG. 6, represents the slope angle between basket bottom wall 20 and the horizontal reference line 28 at cross section 6–6 of FIG. 3.

As can be seen in FIGS. 4–6, the angle $\theta$ varies significantly with circumferential position about basket bottom 20. This change in $\theta$ produces a change in helix angle $\gamma$ as shown by helix angles $\gamma_1$, $\gamma_2$, and $\gamma_3$ for the arrows 29, 30, 31, respectively, creating a variation in direction and amplitude of helical motion of the clothes as they pass over the differently sloped portions of basket bottom wall 20. Although basket bottom wall 20 illustrated in FIGS. 3–6 shows two cycles of change of $\theta$, the number of cycles of change of angle $\theta$ may be selected as required to satisfy a particular design for given orbital angular frequency, $\omega$, amplitude, a, and given basket diameter. In addition, different rates of change of basket bottom slope angle $\theta$ may be employed in each of the sections between adjacent peaks in the magnitude of angle $\theta$ to produce desired patterns of motion of the clothes.

Given the above-described basket bottom construction, a particular desired pattern of clothes motion may be obtained by the appropriate selection of the number of cycles of change through which $\theta$ passes about the circumference of the basket bottom, the rate of slope variation (the slope of the bottom wall in the circumferential direction) in each such section, and the roughness, i.e., resistance to relative sliding motion of cloth in contact with the bottom wall surface, relative to that of the interior surface of the outer wall and the relative roughness of the basket bottom wall in each of the sections of the basket bottom.

Figure 7:
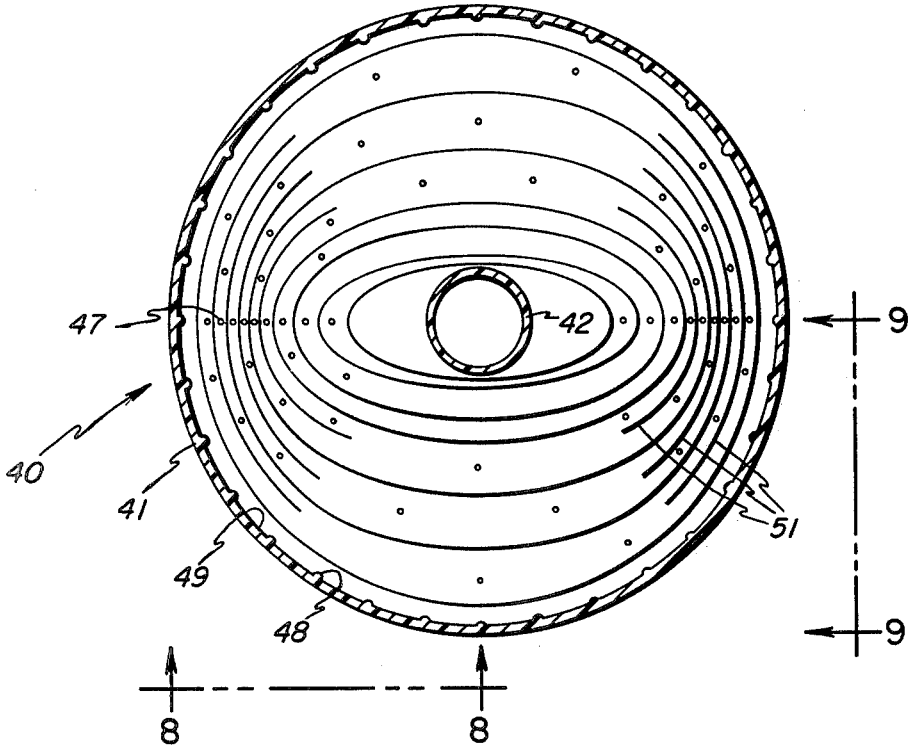
FIG. 7 is a schematic partial cross-sectional top view of a basket for an orbital washer designed according to the instant invention.
Figure 8:
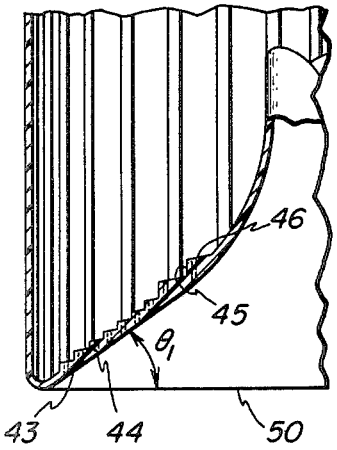
FIG. 8 is a schematic partial cross-sectional view of the basket of FIG. 7 taken along line 8—8 thereof.
Figure 9:
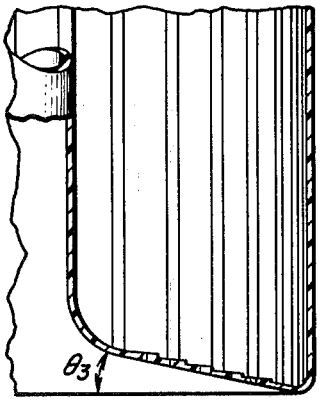
FIG. 9 is a schematic partial cross-sectional view of the basket of FIG. 7 taken along line 7—7 thereof.

A particular preferred embodiment of my instant invention is shown in FIGS. 7–9. The basket 40 includes annular sidewall 41 and center post 42 connected by bottom wall 43. As shown in FIGS. 8 and 9, basket bottom wall 43 comprises a plurality of steps 44 having vertical surfaces 45 and generally horizontal surfaces 46. The surfaces 46 slope generally upwardly in the radially inward direction from the intersection of outer wall 41 and bottom wall 43, which reduces the resistance to relative sliding motion of clothes in contact with surfaces 46, further enhancing turnover motion of the clothes. A plurality of circumferentially-spaced holes 47 pass through generally horizontal surfaces 46. A plurality of generally vertically-extending ribs 48 are attached to the inner surface 49 of outer wall 41 and extend generally vertically-upward from the intersection of bottom wall 43 and outer wall 41 to a height at least equal to the anticipated maximum load level within the basket. Although ribs 48 are shown uniformly distributed on the surface 49 of outer wall 41 could be varied with circumferential position to cause a change in the degree of roughness with circumferential position.

The number of steps 44 as well as the configuration of the steps and their surface roughness may vary with circumferential position about the basket bottom wall 43 to effect clothes turnover rate. For example, grooves or other surface roughness may be added to selected portions of basket bottom wall 43 and omitted from others. Further, the surface condition of both the vertical and horizontal surfaces of the steps could be changed at predetermined circumferential positions to produce variation in roughness with circumferential position about the basket bottom. For example, the number and size of holes 47 which pass through the horizontal surfaces 46 of the steps 44 or other variation in the condition of the horizontal surfaces 46 could be employed to change the surface roughness of the steps with circumferential position about the basket bottom wall. The height of vertical surfaces 45 of steps 44 may increase as the slope angle $\theta$ increases. Alternatively, as shown at 51 in FIG. 7 a larger number of steps 44 may be included in basket bottom wall 43 as slope angle $\theta$ increases, thereby producing a "wavy" circumferentially extending, generally horizontal surface on each of the steps.

Bottom wall 43 has a slope angle $\theta$ relative to a horizontal reference 50 which varies with circumferential position about the basket axis 51 and slopes continuously upwardly from outer basket wall 41 toward center post 42. The smooth generally horizontal surfaces 46 of steps 44 present a surface having a low resistance to relative motion of damp cloth in contact therewith in the generally radially-outward and vertically downward direction and in the generally tangential direction. The vertical surfaces 45 of steps 44 present a surface having a high resistance to relative sliding motion of damp cloth in the generally radially-inward and vertically-upward direction in contact with horizontal surfaces 46 of steps 44. The ribs 48 produce a high resistance to relative motion of damp cloth in sliding contact with the inner surface 49 of outer wall 41.

The above-described combination of basket structures provides a change in the rate of both turnover and turn-around motion. This change causes a change in stretch-release action within the clothes load as it moves circumferentially around the basket. As shown in FIG. 3, helix angle $\gamma$ changes from $\gamma_1$ and $\gamma_2$ and subsequently $\gamma_3$ as clothes pass circumferentially clockwise around the basket during counterclockwise orbiting thereof. This arrangement provides irregular turn-around motion and improved stretch-release action and rubbing action between adjacent pieces of the clothes during the orbiting cycle of the basket.

I claim:

1. A basket for an orbital washer comprising an annular outer wall; and a generally cylindrical center post disposed generally concentrically with said outer wall, a basket bottom wall intersecting said outer wall and said center post wherein:

said bottom wall slopes continuously upwardly from the intersection of said bottom wall and said annular outer wall radially inwardly toward said center post;

said bottom wall is shaped to have a slope angle relative to a horizontal reference which varies continuously with circumferential position about said basket bottom wall; and said annular outer wall includes an internal surface having over a substantial portion of its height extending vertically upwardly from the intersection of said outer wall and said bottom wall a high resistance to relative motion of damp cloth in contact therewith greater than the resistance of the interior surface of said bottom wall to relative motion of the same said damp cloth in contact with said interior surface of said bottom wall.

2. The apparatus of claim 1 wherein said annular outer wall has a plurality of circumferentially spaced, generally vertically extending ribs attached to the inner surface thereof.

3. The apparatus of claim 2 wherein said basket bottom wall comprises a plurality of generally circumferentially-extending steps; each of said steps having a generally horizontal surface extending generally about the circumference of said basket bottom wall and having a low resistance to relative motion in the generally circumferential direction of damp cloth in contact therewith.

4. The apparatus of claim 3 further comprising a plurality of drain holes disposed in spaced circumferential position about the generally horizontal surfaces of said steps.

5. The apparatus of claim 4 wherein each of said steps has a vertical height which varies as said slope angle varies.

6. The apparatus of claim 4 wherein the number of said steps varies with circumferential position about the basket bottom wall.

7. The apparatus of claim 4 wherein said basket bottom wall includes two cycles of change of basket bottom slope in the circumferential direction about the axis of said basket.

8. The apparatus of claim 7 wherein said plurality of generally vertically-extending ribs is uniformly disposed about the circumference of said outer wall.

9. The apparatus of claim 7 wherein said plurality of vertically extending ribs is spaced nonuniformly about the circumference of said asket.

* * * * *